United States Patent [19]

Kan et al.

[11] Patent Number: 4,697,803

[45] Date of Patent: Oct. 6, 1987

[54] SHEET MEMBER FEEDING CASSETTE

[75] Inventors: Yuji Kan; Hiroshi Iwaki, both of Hyogo, Japan

[73] Assignee: Sanyo Electric Co., Ltd.

[21] Appl. No.: 733,622

[22] Filed: May 13, 1985

[30] Foreign Application Priority Data

May 15, 1984 [JP] Japan ..... 59-97903
May 15, 1984 [JP] Japan ..... 59-71242[U]

[51] Int. Cl.[4] ..... B65H 1/12

[52] U.S. Cl. ..... 271/127; 271/164; 271/171; 271/255

[58] Field of Search ..... 271/127, 255, 171, 144, 271/223, 164

[56] References Cited

U.S. PATENT DOCUMENTS 4,343,461 8/1982 Tomimori ..... 271/171 X

FOREIGN PATENT DOCUMENTS 7841 1/1981 Japan ..... 271/171
131642 8/1982 Japan ..... 271/171
36037 2/1984 Japan ..... 271/171

OTHER PUBLICATIONS

IBM Technical Disclosure Bulletin, vol. 18, No. 7, pp. 2057, 2058, Dec. 1975, Paper Size Indication, Colglazier et al.

*Primary Examiner*—Richard A. Schacher
*Attorney, Agent, or Firm*—Darby & Darby

[57] ABSTRACT

A sheet member feeding cassette comprises a main unit wherein sheet members are stored in a stacked manner. A longitudinal hole extending in the direction of feeding sheet member is formed on a supporting plate installed above a bottom plate of the main body, and a pin extending from the bottom plate is inserted into this longitudinal hole so as to be movable along this hole. A bent slit is formed on the long lever supported rotatably by a shaft between the bottom plate and the supporting plate, and the pin is inserted through this slit. By moving a contact plate fixed to the top of the pin along the longitudinal slit, the lever is pushed by the pin, being rotated. A piece to be detected installed outside the main unit and also an indicator panel are fixed to a wire fixed to the free end of the lever. When the position of the contact plate is changed the position of the piece to be detected is changed and also the position of the indicator panel is changed. Thereby, a detecting switch detects the position of the piece to be detected and a signal responding to the position of the contact plate, that is the length of the sheet member is outputted, and the size thereof is indicated visually through a window by the indicator panel.

13 Claims, 6 Drawing Figures

SHEET MEMBER FEEDING CASSETTE

BACKGROUND OF THE INVENTION

1. Field of the Invention

The present invention relates to a sheet member feeding cassette. More specifically, the present invention relates to a so-called universal sheet member feeding cassette which is loaded, for example, in the copier, printer, facsimile or the like and stores sheet members such as papers of arbitrary size therein, feeding the sheet members therefrom.

2. Description of the Prior Art

A so-called universal cassette capable of storing sheet members of arbitrary size therein is disclosed, for example, in the Japanese Utility Model Publication No. 41319/1974 published on Nov. 13, 1974.

In this prior art, a guide plate extending in the direction of feeding paper is installed so as to be movable in the direction orthogonal to the direction of feeding paper. This guide plate contacts with one side edge in the direction of the width of the stored papers. When the size of the papers to be stored is changed, this guide plate is moved to match the size. Then, a cam plate and an operating plate are displaced in interlocking with the displacement of this guide plate. The position of the cam plate is detected by a switch, and a signal is withdrawn from the switch according to the size. A display of the operating plate is indicated through a window.

In this prior art, the guide plate can move in the direction orthogonal to the direction of feeding paper, and accordingly, this guide plate is positioned at a position responding to the width of the stored papers. For this reason, in the prior art, for example, both in the case where the B4-size papers are stored in a manner that the longitudinal direction thereof is the same as the direction of feeding paper and in the case where the B5-size papers are stored in a manner that the longitudinal direction thereof is orthogonal to the direction of feeding paper, the position of the guide plate is the same because of the same width of papers in spite of the difference in size. Accordingly, in the prior art, in such a case, the size cannot be discriminated to be indicated or cannot be detected.

This problem takes place between the letter-size paper and the legal-size paper.

As described above, in the universal cassette of the prior art, the guide plate detects the width of the paper in the direction orthogonal to the direction of feeding the paper to be stored, and therefore the size cannot always be automatically detected or indicated for all sizes of papers.

SUMMARY OF THE INVENTION

Therefore, a principal object of the present invention is to provide a novel sheet member feeding cassette.

Another object of the present invention is to provide a sheet member feeding cassette which is applicable to all sizes of the sheet members.

In the present invention, a first movable member equivalent to the guide plate of the prior art is installed so as to be movable along the direction of feeding sheet member. Accordingly, this first movable member contacts with the rear edge of the stored sheet member. A second movable member is installed outside the cassette main unit. The movement of the first movable member is transmitted to the second movable member by an interlocking means, and accordingly the second movable member is positioned at the position according to the position of the first movable member. This position of the second movable member is detected by a detecting means which is installed separately, and this detecting means outputs a signal corresponding to the position of the second movable member, that is, the first movable member, and thus to the size of the stored sheet members.

Similarly, an indicating member is interlocked with the first movable member. Thereby, the indicating member is moved to the position according to the position of the first movable member, and the information according to the position of the indicating member at that time, that is, the size of the sheet members is indicated visually through a window.

In accordance with the present invention, the rear edge of the sheet member, that is, the length of the sheet member is detected by the first movable member, and therefore the size can be detected or indicated more accurately in comparison with the conventional cassette wherein the width is detected. Accordingly, the sheet member feeding cassette in accordance with the present invention is applicable to a larger number of different sizes of the sheet members in comparison with the conventional one.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
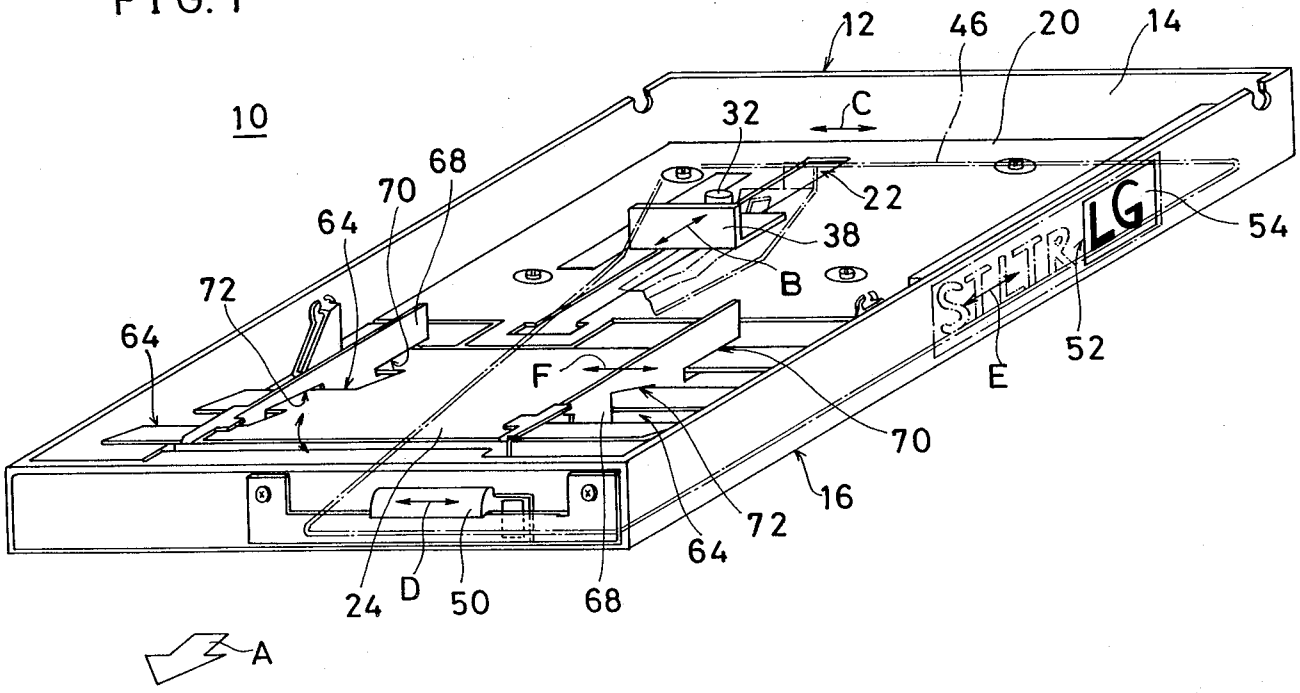
FIG. 1 is a perspective view showing one embodiment in accordance with the present invention.

FIG. 1 is a perspective view showing one embodiment in accordance with the present invention. A cassette 10 comprises a top-opened-box-shaped main unit 12 composed of a side wall 14 and a bottom plate 16. This cassette 10 is loaded, for example, in the copier or other similar apparatus in a freely attachable/detachable manner to be used. Then, sheet members to be fed, for example, papers are stored in the space defined by the side wall 14 of the main unit 12 and are picked up therefrom to be fed, for example, to the transferring station of the copier (not illustrated).

Figure 3:
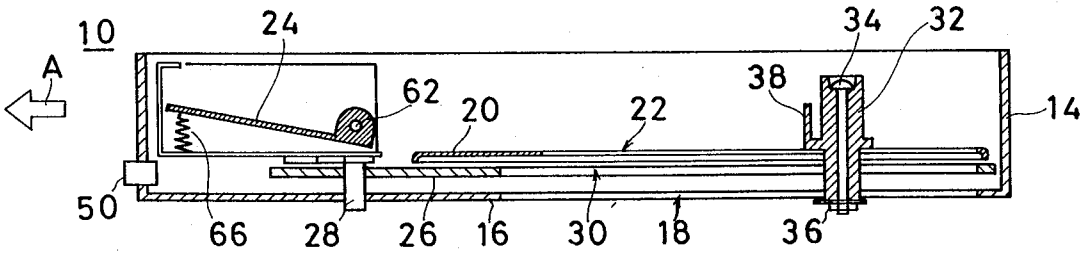
FIG. 3 is an illustrative view showing a cross-section taken along a line III—III in FIG. 2.

As is well understood particularly from FIG. 3, a longitudinal hole 18 extending along the direction of feeding paper is formed on the bottom plate 16 of the main unit 12. Also, a supporting plate 20 is installed above the bottom plate 16 with an interval kept inbetween, and a similar longitudinal hole 22 is formed also on this supporting plate 20. Although not illustrated, sheet members to be fed are put in a stacked fashion on this supporting plate 20. The length of the supporting plate 20 is about three-fifths the length of the main unit 12 starting with the rear edge of the main unit 12, and a push-up plate 24 is installed in front of the supporting plate 20. Accordingly, the sheet members are supported by this push-up plate 24 and the supporting plate 20.

Figure 4:
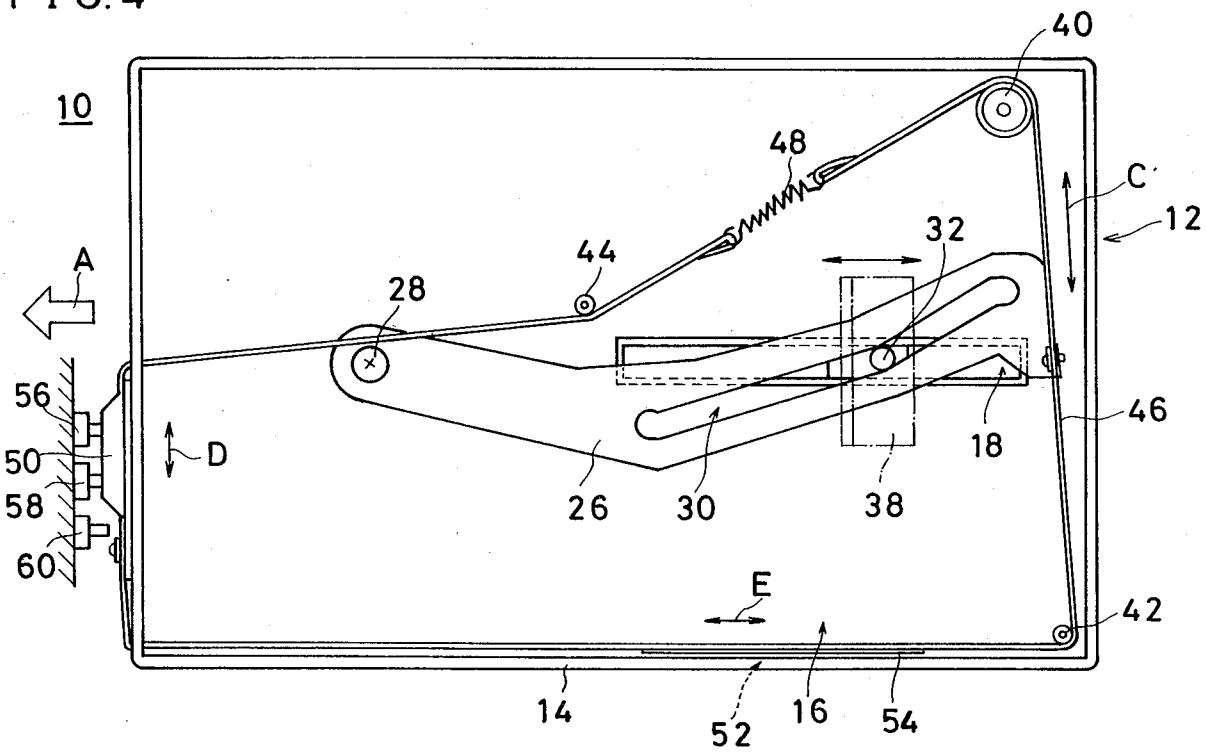
FIG. 4 is an illustrative plan view for explaining the major part of the present embodiment.

As shown in FIG. 3, a lever 26 as shown in FIG. 4 is installed between the bottom plate 16 and the supporting plate 20, and one end of this lever 26 is supported rotatably by a shaft 28 fixed to the bottom plate 16. As is well understood from FIG. 4, the lever 26 is bent gently in a V shape, and on this lever 26, a slit 30 which is bent along the outer shape of the lever 26 is formed. As is described later, this lever 26, that is the slit 30 functions as a cam.

A pin 32 is installed in a manner that it penetrates the longitudinal hole 18 of the bottom plate 16, the slit 30 of the lever 26 and the longitudinal hole 22 of the supporting plate 20 and is movable along the direction of feeding paper as shown in FIG. 3. The pin 32 is tightened gently by a screw 34 and a nut 36, being held on the bottom plate 16. A contact plate 38 having a L-shaped cross-section is fixed to the pin 32 in a one-piece fashion. Accordingly, this contact plate 38 can move in the direction as shown by an arrow mark B along the direction of feeding sheet member (paper), that is, can move back and forth. This contact plate 38 is moved in response to different sizes of papers so as to contact with the rear edge of the stored sheet members.

Meanwhile, in order to support the pin 32 so as to be movable along the direction of feeding paper, a line groove extending in the same direction has only to be formed in place of the longitudinal hole 18 of the bottom plate 16.

As shown in FIG. 4, three pulleys 40, 42 and 44 are mounted free-rotatably on two corners of the rear end part of the bottom plate 16 and near the center of the bottom plate 16. Then, a wire 46 is set around these pulleys 40, 42 and 44. This wire 46 is led outside the side wall 14 in a manner that it runs along the outer surface of the side wall 14 at the front end of the main unit 12. Then, a spring 48 is connected between the both ends of the wire 46 to give this wire 46 a constant tension. A part of the wire 46 is fixed to the free end of the lever 26.

As is well understood from FIG. 1 or FIG. 4, an actuator 50 as a second movable member is fixed to the part of the wire 46 which is led outside the side wall 14. Also, a window 52 such a through hole is formed on a part of the side wall 14, and an indicator panel 54 is disposed inside this window 52. On this indicator panel 54, as is well understood from FIG. 5, for example, a plurality of characters and symbols which represent the size or kind of sheet member are formed in the longitudinal direction thereof. Then, the indicator panel 54 is fixed to a part of the wire 46 as is well understood particularly from FIG. 5. The actuator 50 and indicator panel 54 are displaced in the directions as shown by arrow marks D and E (FIG. 4) with the displacement of the wire 46 in the direction as shown by an arrow mark C.

Three detecting switches 56, 58 and 60 are installed in the vicinity of the actuator 50, for example, on the outside of the copier main unit (not illustrated). These detecting switches 56, 58 and 60 are operated when pushed by the actuator 50, and electric signals are outputted therefrom.

Meanwhile, if the detecting switches 56, 58 and 60 are constituted with optical sensors, a through hole, shutter or the like will be formed on the member to be detected, that is, the actuator 50. Furthermore, other detecting means, for example, a magnetic sensor can be utilized.

According to the size of the sheet member (not illustrated), the contact plate 38 is moved in the direction as shown by the arrow mark B to be brought in contact with the rear edge of the sheet member. When the contact plate 38 is displaced or moved, the pin 32 moves responsively, and the slit 30 wherethrough this pin 32 penetrates, that is the lever 26 makes a swing motion with the shaft 28 acting as a fulcrum, and the free end thereof is displaced in the direction as shown by the arrow mark C (FIG. 1 or FIG. 4). Accordingly, the wire 46 fixed to the free end of the lever 26 is displaced also in the direction as shown by the arrow mark C. Following the displacement of this wire 46, the actuator 50 and the indicator panel 54 fixed thereto are displaced or moved in the directions as shown by the arrow marks D and E, respectively (FIG. 1 or FIG. 4). Thus, the lever 26 and the slit 30 act as a cam means.

In the case where papers of a maximum size, for example, A3-size are stored in this cassette 10, the contact plate 38 is positioned at the uppermost stream side in the direction of feeding paper, that is, at the rearmost end of the position whereto it can be displaced. Accordingly in this state, the free end of the lever 26 deviates most clockwise in FIG. 4. Accordingly, the actuator 50 is located at the uppermost position in FIG. 4, and only the detecting switch 56 is pushed by the actuator 50. Therefore, the signals from the detecting switches 56, 58 and 60 become "1", "0" and "0" respectively, and a signal "100" is transmitted to the copier side, and it is detected that papers of a maximum size (A3) are stored in the cassette 10 at that time.

Also, in this state, the indicator panel 54 is positioned at the leftmost side in FIG. 4, and accordingly an indication is performed so that the characters of that size, for example, "A3" can be made sure from outside through the window 52.

Figure 5:
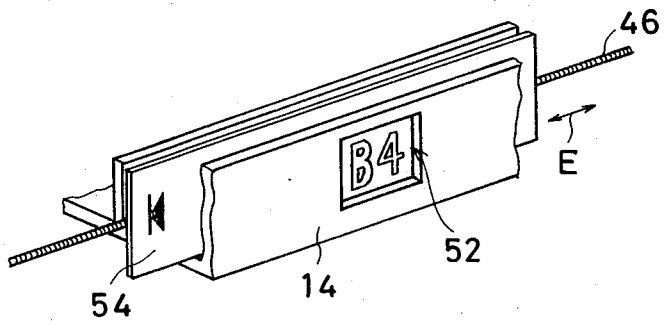
FIG. 5 is an illustrative view showing a relation between a window and an indicator panel.

Meanwhile, in the states as shown in FIG. 4 and FIG. 5, the contact plate 38 is positioned so as to correspond to the size "B4" which is one class smaller than the maximum size "A3".

Figure 2:
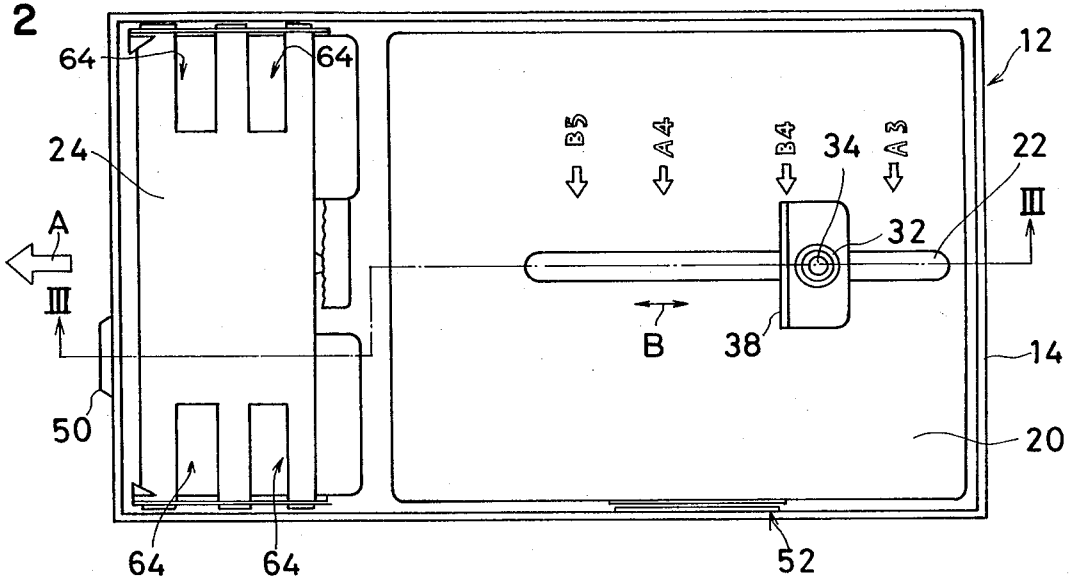
FIG. 2 is a plan view of FIG. 1.

Furthermore, although not illustrated, V-shaped notches are formed respectively at the portions corresponding to each size of the peripheral edge defining the longitudinal hole 18 of the bottom plate 16 (position as shown in FIG. 2), and on the other hand, when a ball capable of entering into and retracting from the respective notches thereof is attached to the pin 32 through springs, the ball of the pin 32 enters the notch corresponding to each size, and the pin 32, that is, the contact plate 38 makes a click operation. Accordingly, by using such notches and a ball (not illustrated), the position of the contact plate 38 can be easily made to correspond to the size of the paper.

Next, description is made on the push-up plate 24 and the related parts thereof particularly in reference to FIG. 1 through FIG. 3. In front of the supporting plate 20, that is, at the downstream side in the direction of feeding paper, the push-up plate 24 is installed whose rear end is supported by a shaft 62. The front end side of the push-up plate 24 can make a swing motion up and down with the shaft 62 acting as a fulcrum. At the side end of this push-up plate 24, as shown in FIG. 1 or FIG. 2, a plurality of notches 64, 64, ---are formed which are cut in the direction orthogonal to the direction of feeding paper. Then, under the front end of the push-up plate 24, a coil spring 66 is installed which elastically biases the push-up plate 24 upward (FIG. 3).

Furthermore, as is well understood from FIG. 1 or FIG. 2, a pair of guide members 68 and 68 extending parallel with each other along the direction of feeding paper are installed at the both side end parts of the push-up plate 24. A notch 70 and a through hole 72 are formed on this pair of guides 68 corresponding to the shape of the side end of the push-up plate 24, and the end part of the push-up plate 24 is inserted through the notch 70 and the through hole 72 of the guide members 68. A pair of guide members 68 can be displaced in the direction orthogonal to the direction of feeding paper, that is, in the direction as shown by an arrow mark F, and accordingly, these guide members 68 define the sheet member to be stored therein, that is, the side end edge of the paper. In other words, the guide members 68 are moved in the direction as shown by the arrow mark F according to the width of the sheet member to be stored, and the guide members contact with the side end edge of the sheet member.

In the present embodiment, the guide members 68 are brought close to or kept apart from each other with the push-up plate 24 sandwiched inbetween, and the push-up plate 24 is present in the interval between these guide members 68. Accordingly, the center part of the sheet member to be stored in the direction of width is supported always by the push-up plate 24. Thus, by always supporting the center part of the sheet member in the direction of width by the supporting member, the problem due to the cassette in the U.S. Pat. No. 4,032,136 can be solved. That is to say, in the cassette as disclosed in the U.S. Pat. No. 4,032,136, no problem takes place in the case where small-sized papers are stored, but in the case where largersized papers are stored, two inner plates which are formed on two side plates respectively in a one-piece fashion are parted greatly, and therefore the center of the paper in the direction of width is not supported from the under side in this case. That is, in this state, the flatness of the stored paper is maintained only by the rigidity of the paper itself. Accordingly, when a paper-feed roller (not illustrated) is press-contacted from the upper side, the center part of the paper in the direction of width is curved downward, and eventually a problem takes place that no reliable pick-up of the paper by the paper-feed roller can be made. On the other hand, in the present embodiment, the center of the stored paper in the direction of width is always supported from the under side by the push-up plate 24, and therefore no problem takes place that the paper is curved even when the paper-feed roller is press-contacted from the upper side, and accordingly a reliable pick-up of the paper by the paper-feed roller can be expected.

Figure 6:
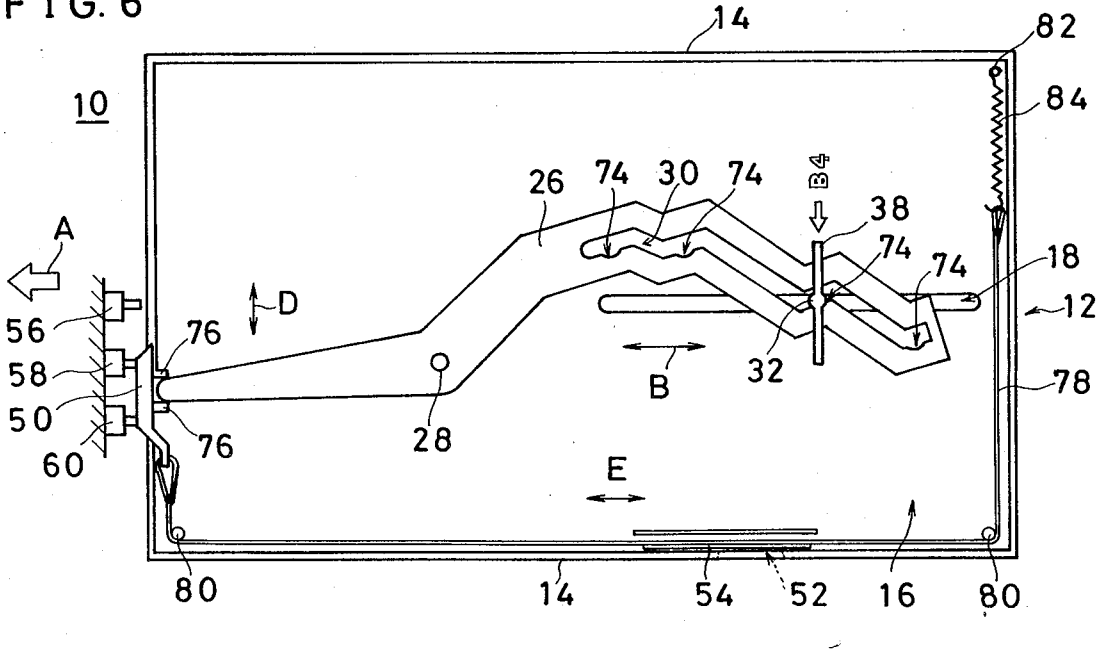
FIG. 6 is an illustrative plan view which shows another embodiment in accordance with the present invention corresponding to FIG. 4.

FIG. 6 is an illustrative plan view showing another embodiment in accordance with the present invention, being depicted corresponding to FIG. 4. In this FIG. 6, the same reference marks are given for the same or similar parts as those in FIG. 4, and the detailed description thereof is omitted. Different points of this second embodiment from the previous embodiment are the shape of the lever 26 and a coupling mechanism of this lever 26 with the actuator 50 and the indicator panel 54.

In FIG. 6, the lever 26 has a length nearly equal to the length of the paper-feed cassette 10, and is supported free-rotatably at the front end thereof, that is, at a point about one-third the total length from the downstream end part in the direction of feeding paper. As shown in FIG. 6, this lever 26 is bent so as to have more nodes than the example as shown in FIG. 4, and the slit 30 which is bent like the outer shape of the lever 26 is formed on this lever 26. On the fringe of the lever 26 defining this slit 30, a plurality of notches 74, 74, --- are formed at the positions corresponding to each size of the paper to be stored. Then, the pin 32 whereto the contact plate 38 is fixed enters one of these notches. Accordingly, the notch 74 causes the contact plate 38 to make a click operation in moving the pin 32, that is, the contact plate 38.

The front end part of the lever 26 is pinched by a pair of protrusions 76 and 76 which extend from the actuator 50 and protrude into the inner part of the side wall 14, and thereby this level 26 is coupled with the actuator 50. Then, one end of the actuator 50 is connected to one end of a wire 78. This wire 78 is set around two pins 80 which are installed at the corner parts of the rear end of the bottom plate 16. The other end of the wire 78 is connected to one end of a spring 84, the other end of which is hooked by a pin 82. Then, the indicator panel 54 is fixed to nearly the center of this wire 78.

When the contact plate 38 is displaced or moved in the direction as shown by the arrow mark B, the lever 26 makes a swing motion and the rotary end, that is, the front end thereof is displaced in the direction as shown by the arrow mark D. Responsively, the actuator 50 coupled wherewith is displaced or moved also in the direction as shown by the arrow mark D. Following the movement of the actuator 50, the wire 78 is pulled by the actuator 50 or the spring 84, and the display panel 54 fixed to this wire 78 is also displaced or moved in the direction as shown in the arrow mark E. Accordingly, the position of the actuator 50 is detected by the corresponding switches 56 through 60, and also a visual display responding to the position of the contact plate 38 at that time, that is, the size of the stored papers is performed through the window 52 formed on the side wall 14.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet member feeding cassette comprising:

a main unit wherein sheet members to be fed are stored, a first movable member which is installed in said main unit so as to be movable along the direction of feeding said sheet members and is for defining the rear edge of the sheet members to be stored therein, a second movable member which is installed movably with respect to the main unit and whose position can be detected by detecting means installed outside said main unit, and interlocking means for moving said second movable member to a predetermined position in response to the position of said first movable member, said interlocking means including coupling means for coupling said first movable member with said second movable member, said coupling means including cam means for converting the movement of said first movable member into the movement in the direction orthogonal to the direction of the movement thereof, and said second movable member being coupled with said cam means, said first movable member being fixed to a pin extending in the perpendicular direction, said cam means including a long-arm lever supported rotatably by a shaft and a slit which is formed on the long-arm lever in a bent fashion and through which said pin is inserted, the lever having a rotary end, the rotary end of said lever being movable in the direction orthogonal to the direction of the movement of said first movable member in response to the movement of said first movable member, and said second movable member being coupled with the rotary end of said lever.

2. A sheet member feeding cassette in accordance with claim 1, wherein said coupling means comprises means for coupling said second movable member directly with said rotary end of said lever.

3. A sheet member feeding cassette in accordance with claim 1, wherein said coupling means comprises means for coupling said second movable member indirectly with said lever.

4. A sheet member feeding cassette in accordance with claim 3, wherein said coupling means comprises a wire which connects said second movable member with said rotary end of said lever.

5. A sheet member feeding cassette in accordance with claim 4, which further comprises a window which is formed on said main unit and an indicator panel which is installed associated with said window and is fixed to said wire.

6. A sheet member feeding cassette comprising:

a main unit which has a side wall and wherein the sheet members to be fed are stored in a manner that the front edges and the rear edges thereof are aligned along the direction of feeding them, a window which is formed on said side wall of said main unit, a movable member which is installed in said main unit so as to be movable along the direction of feeding said sheet members and is for defining the rear edge of the sheet members to be stored therein, an indicator member which is installed associated with said window and different information is indicated visually through said window by the movement thereof, and interlocking means for moving said indicator member to a predetermined position in response to the position of said movable member, said interlocking means comprising coupling means for coupling said movable member with said indicator member, said coupling means comprising cam means for converting the movement of said movable member into a movement in the direction orthogonal to the direction of feeding said sheet member and a wire which is coupled with said cam means, said indicator member being fixed to said wire.

7. A sheet member feeding cassette in accordance with claim 6, which further comprises a second movable member which is coupled with said cam means and whose position is detected by detecting means installed outside said main unit.

8. A sheet member feeding cassette comprising:

a main unit which has a side wall and wherein the sheet members to be fed are stored in a manner that the front edges and the rear edges thereof are aligned along the direction of feeding them, a window which is formed on said side wall of said main unit, a movable member which is installed in said main unit so as to be movable along the direction of feeding said sheet members and is for defining the rear edge of the sheet members to be stored therein, an indicator member which is installed associated with said window and different information is indicated visually through said window by the movement thereof, and interlocking means for moving said display member to a predetermined position in response to the position of said movable member, said interlocking means including coupling means for coupling said movable member with said indicator member, said coupling means including cam means for converting the movement of said first movable member into the movement in the direction orthogonal to the direction of feeding said sheet member and a wire which is coupled with said cam means, and said indicator member being fixed to said wire, said movable member being fixed to a pin extending in the perpendicular direction, said cam means including a long-arm lever which is supported rotatably by a shaft and a slit which is formed on said lever in a bent fashion and wherethrough said pin is inserted, the lever having a rotary end, the rotary end of said lever being movable in the direction orthogonal to the direction of movement of said movable member in response to the movement of said first movable member, said wire being coupled with the rotary end of said lever, and said indicator member being movable in response to the movement of said first movable member.

9. A sheet member feeding cassette comprising:

a main unit which has a side wall and wherein sheet members to be fed are stored so that the front edges and rear edges thereof are aligned along the direction of feeding them, a first movable member which is installed in said main unit so as to be movable along the direction of feeding said sheet member and is for defining the rear edge of the sheet member to be stored therein, a second movable member which is installed movably and whose position can be detected by detecting means installed outside said main unit.

a window which is formed on said side wall of said main unit, an indicator member which is installed movably associated with said window and whereon different information is indicated visually through said window by the movement thereof, and interlocking means for moving said second movable member and said indicator member to predetermined positions in response to the position of said first movable member, said interlocking means including first coupling means for coupling said first movable member with said second movable member and said indicator member, said first coupling means including cam means for converting the movement of said first movable member into the movement in the direction orthogonal to the direction of the movement thereof, and said first coupling means further including second coupling means for coupling said cam means with said second movable member and said display member, said first movable member being fixed to a pin extending in the perpendicular direction, and said cam means including a long-arm lever which is supported rotatably by a shaft and a slit which is formed on said lever in a bent fashion and wherethrough said pin is inserted.

10. A sheet member feeding cassette in accordance with claim 9, wherein the rotary end of said lever is coupled directly with said second movable member, said wire is connected to said second movable member, and said indicator member is fixed to said wire.

11. A sheet member feeding cassette comprising:

a main unit wherein sheet members to be fed are stored, a first movable member which is installed in said unit so as to be movable along a direction of feeding said sheet members and is for defining rear edges of the sheet members to be stored therein, a second movable member which is installed outside said main unit at a side of a front edge of the sheet members so as to be movable along a direction intersecting to said direction of feeding said sheet members and whose position can be detected by detecting means installed outside said main unit, and coupling means for coupling said first movable member with said second movable member, said coupling means including cam means for converting a movement of said first movable member into a movement in the direction intersecting to the direction of the movement of said first movable member.

12. A sheet member feeding cassette comprising:

a main unit which has side walls and wherein the sheet members to be fed are stored in a manner that front edges and rear edges thereof are aligned along a direction of feeding them, a first movable member which is installed in said main unit so as to be movable along said direction of feeding said sheet members and is for defining the rear edges of the sheet members to be stored therein, a second movable member which is installed outside said main unit at a side of a front edge of the sheet members so as to be movable along a direction intersecting to said direction of feeding said sheet members and whose position can be detected by detecting means installed outside said main unit, a window formed on the side wall of said main unit, an indicator member which is installed associated with said window and different information concerning the size of said sheet member is indicated visually through said window by a movement thereof, coupling means for coupling said first movable member with said second movable member, said coupling means including cam means for converting a movement of said movable member into a movement in a direction intersecting to said direction of feeding said sheet member, and a wire which is coupled with said cam means, and to which said indicator member is fixed so as to be moved in accordance with a movement of said first movable member.

13. A sheet member feeding cassette comprising:

a main unit which has a side wall and wherein sheet members to be fed are stored so that the front edges and rear edges thereof are aligned along the direction of feeding them, a first movable member which is installed in said main unit so as to be movable along the direction of feeding said sheet members and is for defining the rear edge of the sheet members to be stored therein, a second movable member which is installed movably and whose position can be detected by detecting means installed outside said main unit, a window which is formed on said side wall of said main unit, an indicator member which is installed movably associated with said window and whereon different information is indicated visually through said window by the movement thereof, and interlocking means for moving said second movable member and said indicator member to predetermined positions in response to the position of said first movable member, said interlocking means including first coupling means for coupling said first movable member with said second movable member and said indicator member, said first coupling means including cam means for converting the movement of said first movable member into the movement in the direction orthogonal to the direction of the movement thereof, and said first coupling means further including second coupling means for coupling said cam means with said second movable member and said indicator member, said second coupling means including a wire which is coupled with said cam means, said first movable member being fixed to a pin extending in the perpendicular direction, said cam means including a long-arm lever which is supported rotatably by a shaft and a slit which is formed on said lever in a bent fashion and wherethrough said pin is inserted, the lever including a rotary end, said wire being connected to the rotary end of said lever, and said second movable member and said indicator member being fixed to said wire.

* * * * *